US011981986B2

(12) United States Patent
Bürger et al.

(10) Patent No.: US 11,981,986 B2
(45) Date of Patent: May 14, 2024

(54) 7XXX-SERIES ALUMINIUM ALLOY PRODUCT

(71) Applicant: Aleris Rolled Products Germany GmbH, Koblenz (DE)

(72) Inventors: Achim Bürger, Rheinland-Pfalz (DE); Sunil Khosla, Nottingham (GB); Christian Gerhard Krechel, Koblenz (DE); Sabine Maria Spangel, Rheinland-Pfalz (DE); Philippe Meyer, Koblenz (DE)

(73) Assignee: NOVELIS KOBLENZ GMBH, Koblenz (DE)

( * ) Notice: Subject to any disclaimer, the term of this patent is extended or adjusted under 35 U.S.C. 154(b) by 232 days.

(21) Appl. No.: 17/421,933

(22) PCT Filed: Jan. 9, 2020

(86) PCT No.: PCT/EP2020/050370
§ 371 (c)(1),
(2) Date: Jul. 9, 2021

(87) PCT Pub. No.: WO2020/148140
PCT Pub. Date: Jul. 23, 2020

(65) Prior Publication Data

US 2022/0112588 A1 Apr. 14, 2022

(30) Foreign Application Priority Data

Jan. 18, 2019 (EP) ..... 19152546

(51) Int. Cl.
*C22C 21/10* (2006.01)
*C22F 1/053* (2006.01)

(52) U.S. Cl.
CPC ..... *C22F 1/053* (2013.01); *C22C 21/10* (2013.01)

(58) Field of Classification Search
CPC ..... C22C 21/10
See application file for complete search history.

(56) References Cited

U.S. PATENT DOCUMENTS

| | | | | |
|---|---|---|---|---|
| 5,049,092 | A | 9/1991 | Takano et al. | |
| 2004/0089378 | A1 | 5/2004 | Senkov et al. | |
| 2008/0173378 | A1* | 7/2008 | Khosla | C22F 1/053 148/552 |

FOREIGN PATENT DOCUMENTS

| | | | |
|---|---|---|---|
| CN | 103233148 | B | 1/2016 |
| EP | 0030070 | A1 | 6/1981 |
| EP | 0829552 | A1 | 3/1998 |
| EP | 0863220 | | 9/1998 |
| JP | 2011058047 | A | 3/2011 |
| JP | 2012214905 | A | 11/2012 |
| RU | 2406773 | | 12/2010 |
| RU | 2425902 | | 8/2011 |
| RU | 2443793 | | 2/2012 |
| RU | 2443797 | | 2/2012 |

OTHER PUBLICATIONS

Fischer et al., "Eine Abschreckunempfindliche AlZnMgCu-Legierung Mit Zusatzen von Chrom, Zirkon und Silber", Alumin, vol. 48, No. 6, Jun. 1, 1972, pp. 413-418.
Ghosh et al., "Characterisation of High Pressure Torsion Processed 7150 Al—Zn—Mg—Cu Alloy", Materials Science and Engineering: A, vol. 552, Aug. 30, 2012, 2 pages.
Marlaud et al., "Relationship Between Alloy Composition, Microstructure and Exfoliation Corrosion in Al—Zn—Mg—Cu Alloys", Corrosion Science, vol. 53, No. 10, Oct. 10, 2011, pp. 3139-3149.
International Application No. PCT/EP2020/050370 , International Search Report and Written Opinion, dated Mar. 25, 2020, 11 pages.
Brazilian Application No. 112021009138-6 , "Office Action", dated Jul. 18, 2023, 5 pages.
Chinese Application No. 202080009708.7 , Office Action, dated Dec. 30, 2021, 21 pages.
Indian Application No. 202117032036 , "First Examination Report", dated Mar. 21, 2022, 7 pages.
Canadian Application No. 3,118,997 , Office Action, dated Mar. 24, 2022, 4 pages.
Russian Application No. 2021115261 , Office Action, dated Mar. 31, 2022, 12 pages.
Canadian Application No. 3,118,997 , "Notice of Allowance", dated Apr. 17, 2023, 1 page.
Chinese Application No. 202080009708.7 , "Office Action", dated Jan. 9, 2023, 6 pages.

(Continued)

*Primary Examiner* — Adam Krupicka

(74) *Attorney, Agent, or Firm* — Kilpatrick Townsend & Stockton LLP

(57) ABSTRACT

The invention relates to a wrought 7xxx-series aluminium alloy product having a composition comprising, in wt. %, Zn 6.40 to 7.50, Mg 2.15 to 2.75, Cu 1.20 to 2.00, and wherein Cu+Mg<4.50, and wherein Mg<2.5+5/3(Cu−1.2), Fe up to 0.25, Si up to 0.25, and optionally one or more elements selected from the group consisting of: (Zr up to 0.3, Cr up to 0.3, Mn up to 0.45, Ti up to 0.25, Sc up to 0.5, Ag up to 0.5), the balance being aluminium and impurities, and having been aged to achieve a conventional tensile yield strength (in MPa) measured in the L-direction measured at quarter thickness of more than 485−0.12*(t−100) MPa (t being the thickness of the product in mm); a minimum life without failure due to stress corrosion cracking (SCC) measured in accordance with ASTM G47-98 of at least 30 days at a short transverse (ST) stress level of 170 MPa; and a minimum $K_{max\text{-}dev}$ value without crack deviation due to crack propagation testing in standard atmosphere at room temperature in accordance with ASTM E647-13e01 in L-S direction on CT samples of at least 40 MPa√m on average.

21 Claims, 1 Drawing Sheet

(56) References Cited

OTHER PUBLICATIONS

Japanese Application No. 2021-528963 , "Notice of Decision to Grant", dated Apr. 4, 2023, 4 pages.
Chinese Application No. 202080009708.7 , "Office Action", dated Jul. 5, 2022, 16 pages.
European Application No. 20700114.0, "Notification of Intent to Grant", dated Jul. 4, 2022, 28 pages.
Japanese Application No. 2021-528963 , "Office Action", dated May 31, 2022, 11 pages.
Russian Application No. 2021115261 , "Notice of Decision to Grant", dated Jul. 26, 2022, 19 pages.
Canadian Application No. 3,118,997 , "Office Action", dated Oct. 21, 2022, 3 pages.
Japanese Application No. 2021-528963 , "Office Action", dated Dec. 20, 2022, 8 pages.
Korean Application No. 10-2021-7015294 , "Office Action", dated Jan. 30, 2023, 7 pages.
"American National Standard Alloy and Temper Designation Systems for Aluminum", Secretariat the Aluminum Association, The Aluminum Association Inc., 2009, 13 pages.
"English Translation of CN 103233148 B", Jan. 20, 2016, 42 pages.
"Heat Treating of Aluminum Alloys", ASM Handbook, vol. 4, 1991, pp. 841-879.
"International Alloy Designations and Chemical Composition Limits for Wrought Aluminum and Wrought Aluminum Alloys", The Aluminum Association, Inc., 2015, 38 pages.
"Rolling Aluminum: From the Mine Through the Mill", The Aluminum Association, Dec. 2007, 135 pages.
Dutkiewicz et al., "Structure, Texture and Mechanical Properties of AlZnMgCuZr alloy rolled after heat treatments", Materials & Design, vol. 18, Issues 4-6, 1997, pp. 247-252.
European Application No. 20700114.0 , "Notice of Opposition", dated Sep. 6, 2023, 1 page.
European Application No. 20700114.0 , "Notice of Opposition", dated Aug. 29, 2023, 68 pages.
Kaufman , "Introduction to Aluminum Alloys and Tempers", ASM International, Jan. 1, 2000, pp. 39-76.
Rometsch et al., "Heat Treatment of 7xxx Series Aluminium Alloys—Some Recent Developments", Transactions of Nonferrous Metals Society of China, vol. 24, 2014, pp. 2003-2017.
Starke Jr. et al., "Application of Modern Aluminum Alloys to Aircraft", Progress in Aerospace Sciences, vol. 32, 1996, pp. 131-172.
European Application No. 20700114.0 , "Summons to Attend Oral Proceedings", Feb. 29, 2024, 27 pages.

* cited by examiner

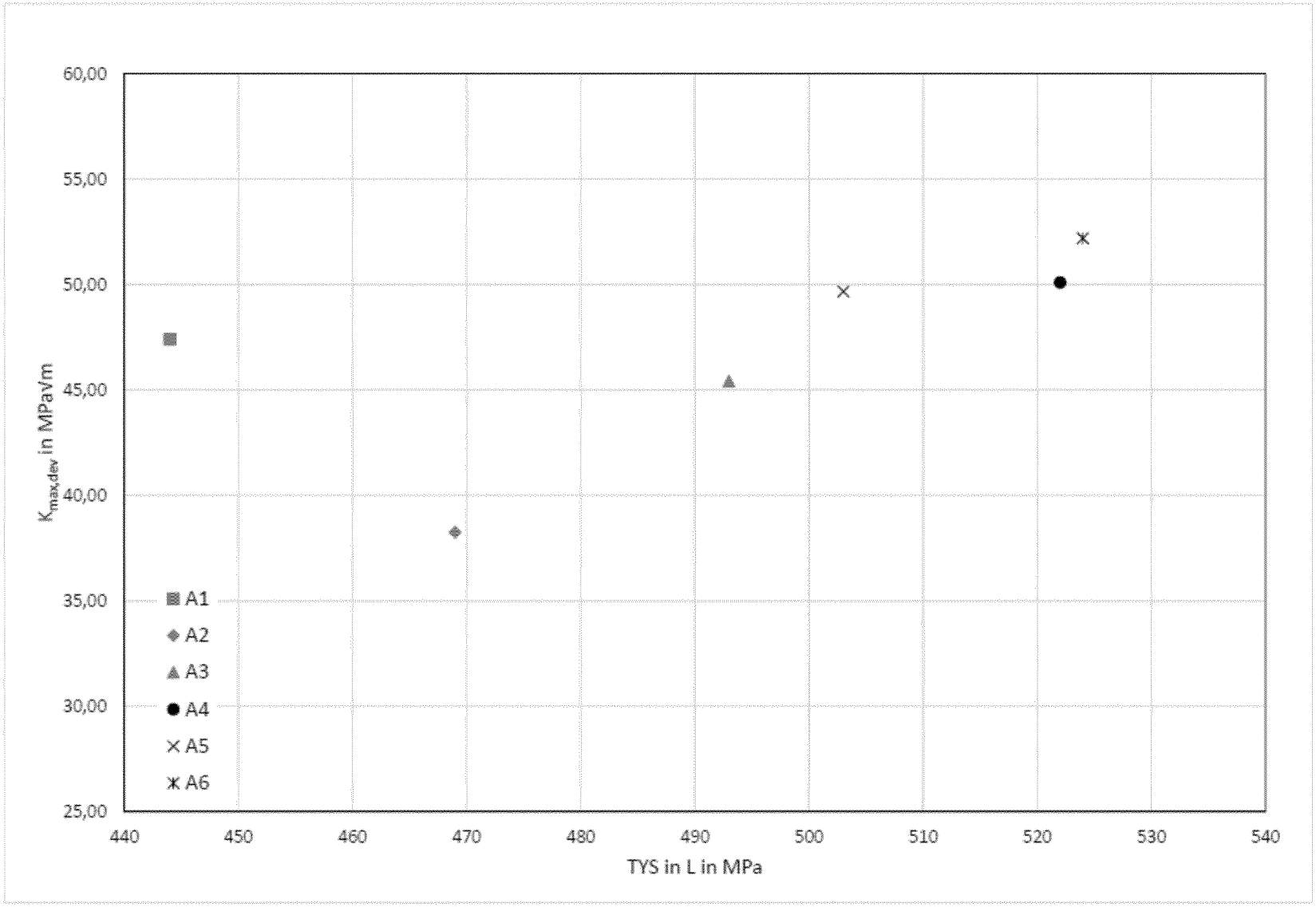
60,00
55,00
50,00
45,00
40,00
35,00
30,00
25,00
$K_{max,dev}$ in MPa√m
440
450
460
470
480
490
500
510
520
530
540
TYS in L in MPa
A1
A2
A3
A4
A5
A6

7XXX-SERIES ALUMINIUM ALLOY PRODUCT

FIELD OF THE INVENTION

The invention relates to a wrought Al—Zn—Mg—Cu aluminium type (or 7000- or 7xxx-series aluminium alloys as designated by the Aluminium Association). More specifically, the present invention is related to an age-hardenable, high strength, highly stress corrosion resistant aluminium alloy which has an improved crack deviation resistance, and products made of that aluminium alloy. Products made from this alloy are very suitable for aerospace applications, but not limited to that. The aluminium alloy can be processed to various product forms, e.g. thin plate, thick plate, extruded or forged products.

BACKGROUND TO THE INVENTION

High strength aluminium alloys which are based on the aluminium-zinc-magnesium-copper system are used in numerous applications. Typically, the property profile of these alloys needs to be tuned to the application and it is difficult to improve one property without adversely affecting other properties. For example, strength and corrosion resistance need to be balanced by applying the most suitable temper for the target application. Another property of relevance is the resistance to crack deviation, where crack path deviation in a material can occur when a susceptible alloy is subjected to fatigue loading on a pre-crack in a L-S sample. This phenomenon can be a challenge for component manufacturers since under certain conditions the structural integrity can be affected. Sensitivity to crack deviation has been observed especially in Zn containing high strength aluminium alloys. Therefore, there is a need for aluminium alloys which combine a high strength with good SCC corrosion resistance and at the same time having an increased resistance to crack deviation.

European patent EP-0863220-B2 discloses a screw or rivet for use in the automotive industry and made from an AlZnMgCu alloy via extrusion, and wherein the AlZnMgCu alloy consists of, in wt. %, 6.0-8.0% Zn, 2.0-3.5% Mg, preferably 2.6-2.9% Mg, 1.6-1.9% Cu, 0.05-0.30% Zr, max. 0.10% Cr, max. 0.50% Mn, max. 0.10% Ti, max. 0.20% Si, max. 0.20% Fe, other elements each max. 0.05%, total max. 0.15%, balance aluminium and unavoidable impurities.

BRIEF DESCRIPTION OF DRAWINGS

FIG. 1—Plot of $K_{max,dev}$ against the TYS in L-direction for tested alloys.

DESCRIPTION OF THE INVENTION

As will be appreciated herein, except as otherwise indicated, aluminium alloy designations and temper designations refer to the Aluminium Association designations in Aluminium Standards and Data and the Registration Records, as published by the Aluminium Association in 2018 and are well known to the person skilled in the art. The temper designations are laid down in European standard EN515.

For any description of alloy compositions or preferred alloy compositions, all references to percentages are by weight percent unless otherwise indicated.

As used herein, the term "about" when used to describe a compositional range or amount of an alloying addition means that the actual amount of the alloying addition may vary from the nominal intended amount due to factors such as standard processing variations as understood by those skilled in the art.

The term "up to" and "up to about", as employed herein, explicitly includes, but is not limited to, the possibility of zero weight-percent of the particular alloying component to which it refers. For example, up to 0.5% Sc may include an aluminium alloy having no Sc.

It is an object of the invention to provide a wrought 7xxx-series aluminium alloy product having an improved balance of high strength, high SCC resistance and having an improved resistance to crack deviation.

This and other objects and further advantages are met or exceeded by the present invention providing a wrought 7xxx-series aluminium alloy product, and preferably having a gauge of at least 12.7 mm (0.5 inches), and having a composition comprising, in wt. %, Zn 6.40% to 7.50%,
Mg 2.15% to 2.85%,
Cu 1.20% to 2.00%,
and with the proviso for the Cu- and Mg-content such that Cu+Mg<4.50% and Mg<2.5+5/3(Cu−1.2),
Fe up to 0.25%, preferably up to 0.15%,
Si up to 0.25%, preferably up to 0.15%,
and optionally one or more elements selected from the group consisting of:
Zr up to 0.3%,
Cr up to 0.3%,
Mn up to 0.45%,
Ti up to 0.25%, preferably up to 0.15%,
Sc up to 0.5%,
Ag up to 0.5%,
the balance being aluminium and impurities. Typically, such impurities are present each <0.05% and total <0.15%, and the product is aged to have the following properties:

a conventional tensile yield strength (in MPa) measured in accordance with ASTM-B557-15 standard in the L-direction measured at quarter thickness of more than 485-0.12*(t−100) MPa (t being the thickness of the product in mm). In a preferred embodiment the tensile yield strength is >500-0.12(t−100) MPa, and more preferably >510-0.12(t−100) MPa.

a minimum life without failure due to stress corrosion cracking (SCC) measured in accordance with ASTM G47-98 of at least 30 days at a short transverse (ST) stress level of 170 MPa. In a preferred embodiment at a short transverse (ST) stress level of 205 MPa, and more preferably of 240 MPa.

a minimum $K_{max-dev}$ value without crack deviation due to crack propagation testing in standard atmosphere at room temperature in accordance with ASTM E647-13e01 in L-S direction on CT samples of at least 40 MPa√m on average, preferably of at least 45 MPa√m on average, more preferably of at least 50 MPa√m on average, testing in a load controlled fatigue test and crack deviation defined as a crack deviating more than 20° from the intended fracture plane. As used herein, "crack deviation resistance" is determined by preparing at least triplicate C(T) specimens in accordance with ASTM E647-13e01, entitled "Standard Test Method for Measurement of Fatigue Crack Growth Rates" ("ASTM E647"). The at least triplicate C(T) specimens are taken in the L-S direction from between width/3 and 2width/3 of the material, where the "B" dimension of the specimen is 6.35 mm (0.25 inch) and the "W"

dimension of the specimen is at least 25 mm (0.98 inches), taken from T/2 position. The test specimens are tested per the constant load amplitude test method of ASTM E647, with R=0.1 (equal to $P_{min}/P_{max}$), ambient or high humidity air, at room temperature. The pre-crack must meet all validity requirements of ASTM E647, and the pre-cracking must be performed as required in ASTM E647. The test is started using a $K_{max}$>10 MPa√m. (9.098 ksi√inch), and the starting force must be large enough that crack deviation occurs before the ASTM E647 C(T) specimen validity requirement $((W-a) \geq (4/\pi)*(K_{max-dev}/TYS)^2)$ is no longer met for the test. The test must be valid per ASTM E647 up to the point of crack deviation. A crack "deviates" when the crack of the C(T) specimen substantially deviates from the intended fracture plane (e.g., by 20-110°) in any direction, and the deviation leads to specimen separation along an unintended fracture plane. The average crack length at deviation ($a_{dev}$) is derived by using the average of the two surface values (front and back values). $K_{max-dev}$ is the maximum stress-intensity factor calculated by using the average crack length at deviation ($a_{dev}$), maximum applied force ($P_{max}$), and the stress-intensity factor expression per ASTM E647 A1.5.1.1 for the C(T) specimen (Note: ΔK and ΔP should be replaced by $K_{max-dev}$ and $P_{max}$, respectively, per the stress ratio relationship $R=K_{min}/K_{max}$ and $\hat{}K=K_{max}-K_{min}$ as defined in ASTM E6473.2.14).

By careful control of in particular the Zn, Cu and Mg levels in the aluminium alloy, and when aged in particular to a T7 condition, the wrought 7xxx-series aluminium alloy product thus provides an improved balance of high strength, high SCC resistance in combination with having a good crack deviation resistance.

In an embodiment, the wrought aluminium alloy product has a Zn-content of maximum 7.30%, and preferably of maximum 7.10%. A preferred minimum Zn-content is 6.50%, more preferably 6.60%, and most preferably 6.75%, to obtain sufficient strength.

In an embodiment, the wrought aluminium alloy product has a Cu-content of maximum 1.90%, and preferably of maximum 1.80%, and more preferably of maximum 1.75%, and most preferably of maximum 1.70%. A preferred minimum Cu-content is 1.30%, and more preferably 1.35%, to provide sufficient strength in combination with a high minimum $K_{max-dev}$ value without crack deviation.

In an embodiment, the wrought aluminium alloy product has a Mg-content of at least 2.25%, and preferably of at least 2.30%, more preferably of at least 2.35%, and most preferably of at least 2.45%, to provide sufficient strength in combination with an increased minimum $K_{max-dev}$ value without crack deviation. In an embodiment the wrought aluminium alloy product has a Mg-content of maximum 2.75%, preferably of maximum 2.60%, and more preferably of maximum 2.55%.

In a preferred embodiment, the wrought aluminium alloy product has Zn 6.40% to 7.30%, Mg 2.25% to 2.75%, and Cu 1.25% to 1.90%, and with the proviso Cu+Mg<4.45 and Mg<2.55+2(Cu−1.25).

In more preferred embodiment, the wrought aluminium alloy product has Zn 6.50% to 7.20%, Mg 2.30% to 2.60%, and Cu 1.30% to 1.80%.

In more preferred embodiment, the wrought aluminium alloy product has Zn 6.75% to 7.10%, Mg 2.35% to 2.55%, and Cu 1.35% to 1.75%.

In a most preferred embodiment, the wrought aluminium alloy product has Zn 6.75% to 7.10%, Mg 2.45% to 2.55%, and Cu 1.35% to 1.75%.

An overview of the preferred Zn, Cu and Mg ranges for the wrought aluminium alloy product according to the invention is given in Table 1 below.

TABLE 1

An overview of the preferred Zn, Cu and Mg ranges in the wrought 7xxx-series aluminium alloy product according to this invention.

| | Zn | Mg | Cu | Proviso |
|---|---|---|---|---|
| Broad | 6.40-7.50 | 2.15-2.85 | 1.20-2.00 | Cu + Mg < 4.50 & Mg < 2.5 + 5/3*(Cu − 1.2) |
| Preferred | 6.40-7.30 | 2.25-2.75 | 1.25-1.90 | Cu + Mg < 4.45 & Mg < 2.55 + 2*(Cu − 1.25) |
| More preferred | 6.50-7.20 | 2.30-2.60 | 1.30-1.80 | — |
| More preferred | 6.75-7.10 | 2.35-2.55 | 1.35-1.75 | — |
| Most preferred | 6.75-7.10 | 2.45-2.55 | 1.35-1.75 | — |

In an embodiment, the wrought aluminium alloy product further comprises up to 0.3% of one or more elements selected from the group of V, Ni, Co, Nb, Mo, Ge, Er, Hf, Ce, Y, Dy, and Sr.

The iron and silicon contents should be kept significantly low, for example not exceeding about 0.15% Fe, and preferably less than 0.10% Fe, and not exceeding about 0.15% Si and preferably 0.10% Si or less. In any event, it is conceivable that still slightly higher levels of both impurities, at most about 0.25% Fe and at most about 0.25% Si may be tolerated, though on a less preferred basis herein.

The wrought aluminium alloy product comprises optionally one or more dispersoid forming elements to control the grain structure and the quench sensitivity selected from the group consisting of: Zr up to 0.3%, Cr up to 0.3%, Mn up to 0.45%, Ti up to 0.25%, Sc up to 0.5%.

A preferred maximum for the Zr level is 0.25%. A suitable range of the Zr level is about 0.03% to 0.25%, and more preferably about 0.05% to 0.18%, and most preferably about 0.05% to 0.13%. Zr is the preferred dispersoid forming alloying element in the aluminium alloy product according to this invention.

The addition of Sc is preferably not more than about 0.5% and more preferably not more than about 0.3%, and most preferably not more than about 0.25%. A preferred lower limit for the Sc addition is 0.03%, and more preferably 0.05%. In an embodiment, when combined with Zr, the sum of Sc+Zr should be less than 0.35%, preferably less than 0.30%.

Another dispersoid forming element that can be added, alone or with other dispersoid formers is Cr. Cr levels should preferably be below 0.3%, and more preferably at a maximum of about 0.25%, and most preferably at a maximum of about 0.22%. A preferred lower limit for the Cr would be about 0.04%.

In another embodiment of the aluminium alloy wrought product according to the invention it is free of Cr, in practical terms this would mean that it is considered an impurity and the Cr-content is up to 0.05%, and preferably up to 0.04%, and more preferably only up to 0.03%.

Mn can be added as a single dispersoid former or in combination with any one of the other mentioned dispersoid formers. A maximum for the Mn addition is about 0.4%. A practical range for the Mn addition is in the range of about 0.05% to 0.4%, and preferably in the range of about 0.05% to 0.3%. A preferred lower limit for the Mn addition is about 0.12%. When combined with Zr, the sum of Mn plus Zr should be less than about 0.4%, preferably less than about 0.32%, and a suitable minimum is about 0.12%.

In another embodiment of the aluminium alloy wrought product according to the invention it is free of Mn, in practical terms this would mean that it is considered an impurity and the Mn-content is up to 0.05%, and preferably up to 0.04%, and more preferably only up to 0.03%.

In another embodiment each of Cr and Mn are present only at impurity level in the aluminium alloy wrought product. Preferably the combined presence of Cr and Mn is only up to 0.05%, preferably up to 0.04%, and more preferably up to 0.02%.

Silver (Ag) in a range of up to 0.5% can be purposively added to further enhance the strength during ageing. A preferred lower limit for the purposive Ag addition would be about 0.05% and more preferably about 0.08%. A preferred upper limit would be about 0.4%.

In an embodiment the Ag is an impurity element and it can be present up to 0.05%, and preferably up to 0.03%.

In an embodiment the wrought 7xxx-series aluminium alloy product, preferably having a gauge of at least 12.7 mm (0.5 inches), has a composition consisting of, in wt. %, Zn 6.40% to 7.50%,
Mg 2.15% to 2.85%,
Cu 1.20% to 2.00%,
and with the proviso Cu+Mg<4.50 and Mg<2.5+5/3(Cu−1.2),
Fe up to 0.25%,
Si up to 0.25%,
and optionally one or more elements selected from the group consisting of:
Zr up to 0.3%,
Cr up to 0.3%,
Mn up to 0.45%,
Ti up to 0.25%,
Sc up to 0.5%,
Ag up to 0.5%,
the balance being aluminium and impurities each <0.05%, total <0.15%, and with preferred narrower compositional ranges as herein described and claimed.

In another embodiment the wrought 7xxx-series aluminium alloy product, preferably having a gauge of at least 12.7 mm (0.5 inches), has a composition consisting of, in wt. %, Zn 6.40% to 7.50%,
Mg 2.15% to 2.85%,
Cu 1.20% to 2.00%,
and with the proviso Cu+Mg<4.50 and Mg<2.5+5/3(Cu−1.2),
Fe up to 0.25%, preferably up to 0.15%,
Si up to 0.25%, preferably up to 0.15%,
Zr 0.05% to 0.18%, preferably 0.05% to 0.13%,
Ti up to 0.25%, preferably up to 0.15%,
the balance being aluminium and impurities each <0.05%, total <0.15%, and with preferred narrower compositional ranges as herein described and claimed.

To provide the best balance in strength, SCC resistance and improved crack deviation resistance the wrought product is preferably provided in an over-aged T7 condition. More preferably a T7 condition selected from the group consisting of: T73, T74, T76, T77, and T79.

In a preferred embodiment the wrought product is provided in a T74 temper, more in particular a T7451 temper, or in a T76 temper, more in particular in a T7651 temper.

In a preferred embodiment the wrought product is provided in a T77 temper, more in particular a T7751 temper, or in a T79 temper, more in particular in a T7951 temper.

In a preferred embodiment the wrought product according to this invention has a nominal thickness of at least 12.7 mm (0.5 inches). In a further embodiment the thickness is at least 25.4 mm (1.0 inches). In yet a further embodiment the thickness is at least 38.1 mm (1.5 inches), and preferably at least 76.2 mm (3.0 inches). In an embodiment, the maximum thickness is 304.8 mm (12.0 inches). In a preferred embodiment the maximum thickness is 254 mm (10.0 inches) and more preferably 203.2 mm (8.0 inches).

The wrought product can be provided in various forms, in particular as a rolled product, an extruded product or as a forged product.

In a preferred embodiment the wrought product is provided as a rolled product, more in particular as a rolled plate product.

In an embodiment the wrought product is an aerospace product, more in particular an aircraft structural part, e.g. a wing spar, wing rib, wing skin, floor beam, or fuselage frame.

In a particular embodiment the wrought product is provided as a rolled product, ideally as an aircraft structural part, having a thickness in a range of 38.4 mm (1.5 inches) to 307.2 mm (12.0 inches), and with preferred narrower ranges as herein described and claimed, and is provided in a T7 condition, more preferably in a T74 or T76 condition. In this embodiment the rolled product has the properties as herein described and claimed.

In a particular embodiment the wrought product is provided as a rolled product, ideally as an aircraft structural part, having a thickness in a range of 38.1 mm (1.5 inches) to 304.8 mm (12.0 inches), and with preferred narrower ranges as herein described and claimed, and is provided in a T76 condition, more preferably a T7651 condition. In this embodiment the rolled product has the properties as herein described and claimed.

In a further aspect of the invention it relates to a method of producing the wrought 7xxx-series aluminium alloy product, preferably having a gauge of at least 12.7 mm (0.5 inches), the method comprising the steps, in that order, of:

a. casting stock of an ingot of the AA7000-series aluminium alloy according to this invention,
b. preheating and/or homogenizing the cast stock,
c. hot working the stock by one or more methods selected from the group consisting of rolling, extrusion, and forging;
d. optionally cold working the hot worked stock;
e. solution heat treating ("SHT") of the hot worked and optionally cold worked stock;
f. cooling the SHT stock, preferably by one of spray quenching or immersion quenching in water or other quenching media;

g. optionally stretching or compressing of the cooled SHT stock or otherwise cold working of the cooled SHT stock to relieve stresses, for example levelling or drawing or cold rolling of the cooled SHT stock;

h. artificial ageing of the cooled and optionally stretched or compressed or otherwise cold worked SHT stock to achieve the desired temper, preferably to a T7 condition.

The aluminium alloy can be provided as an ingot or slab or billet for fabrication into a suitable wrought product by casting techniques regular in the art for cast products, e.g. Direct-Chill (DC)-casting, Electro-Magnetic-Casting (EMC)-casting, Electro-Magnetic-Stirring (EMS)-casting. Slabs resulting from continuous casting, e.g. belt casters or roll casters, also may be used, which in particular may be advantageous when producing thinner gauge end products. Grain refiners such as those containing titanium and boron, or titanium and carbon, may also be used as is well-known in the art. The Ti-content in the aluminium alloy is up to 0.25%, and preferably up to 0.15%, and more preferably in a range of 0.01% to 0.1%. Optionally a cast ingot can be stress relieved, for example by holding it at a temperature in a range of about 350° C. to 450° C. followed by slow cooling to ambient temperature. After casting the alloy stock, an ingot is commonly scalped to remove segregation zones near the as-cast surface of the ingot.

The purpose of a homogenisation heat treatment has at least the following objectives: (i) to dissolve as much as possible coarse soluble phases formed during solidification, and (ii) to reduce concentration gradients to facilitate the dissolution step. A preheat treatment achieves also some of these objectives.

Commonly a pre-heat refers to the heating of an ingot to a set temperature and soaking at this temperature for a set time followed by the start of the hot rolling at about that temperature. Homogenisation refers to a heating, soaking and cooling cycle with one or more soaking steps, applied to a rolling ingot in which the final temperature after homogenisation is ambient temperature.

A typical pre-heat treatment for the AA7xxx-series alloy used in the method according to this invention would be a temperature of 390° C. to 450° C. with a soaking time in the range of 2 to 50 hours, more typically for 2 to 20 hours.

Firstly, the soluble eutectic phases and/or intermetallic phases such as the S-phase, T-phase, and M-phase in the alloy stock are dissolved using regular industry practice. This is typically carried out by heating the stock to a temperature of less than 500° C., typically in a range of 450° C. to 485° C., as S-phase ($Al_2MgCu$-phase) has a melting temperature of about 489° C. in AA7xxx-series alloys and the M-phase ($MgZn_2$-phase) has a melting point of about 478° C. This can be achieved by a homogenisation treatment in said temperature range and allowed to cool to the hot rolling temperature, or after homogenisation the stock is subsequently cooled and reheated before hot rolling. The homogenisation process can also be done in two or more steps if desired, and which are typically carried out in a temperature range of 430° C. to 490° C. for the AA7xxx-series alloy. In a particular favourable embodiment a two-step homogenisation process is applied, there is a first step between 455° C. and 470° C., and a second step between 470° C. and 485° C., to optimise the dissolving process of the various phases depending on the exact alloy composition.

The soaking time at the homogenisation temperature is in the range of 1 to 50 hours, and more typically for 2 to 20 hours. The heat-up rates that can be applied are those which are regular in the art.

Following the preheat and/or homogenisation practice the stock is hot worked by one or more methods selected from the group consisting of rolling, extrusion, and forging. The method of hot rolling is preferred for the present invention.

The hot working, and hot rolling in particular, may be performed to a final gauge of preferably 12.7 mm (0.5 inches) or more.

In an embodiment the plate material is hot rolled in a first hot rolling step to an intermediate hot rolled gauge, followed by an intermediate annealing step and then hot rolled in a second hot rolling step to final hot rolled gauge.

In another embodiment the plate material is hot rolled in a first hot rolling step to an intermediate hot rolled gauge, followed by a recrystallization annealing treatment at a temperature up to the SHT temperature range and then hot rolled in a second hot rolling step to final hot rolled gauge. This will improve the isotropy of the properties and can further increase the resistance against crack deviation.

Alternatively, the hot working step can be performed to provide stock at intermediate gauge. Thereafter, this stock at intermediate gauge can be cold worked, e.g. by means of rolling, to a final gauge. Depending on the amount of cold work an intermediate anneal may be used before or during the cold working operation.

A next process step is solution heat treating ("SHT") of the hot worked and optionally cold worked stock. The product should be heated to bring as much as possible all or substantially all portions of the soluble zinc, magnesium and copper into solution. The SHT is preferably carried out in the same temperature range and time range as the homogenisation treatment according to this invention as set out in this description, together with the preferred narrower ranges. However, it is believed that also shorter soaking times can still be very useful, for example in the range of about 2 to 180 minutes. The SHT is typically carried out in a batch or a continuous furnace. After SHT, it is important that the aluminium alloy be cooled with a high cooling rate to a temperature of 175° C. or lower, preferably to ambient temperature, to prevent or minimise the uncontrolled precipitation of secondary phases, e.g. $Al_2CuMg$ and $Al_2Cu$, and/or $MgZn_2$. On the other hand cooling rates should preferably not be too high to allow for a sufficient flatness and low level of residual stresses in the product. Suitable cooling rates can be achieved with the use of water, e.g. water immersion or water jets.

The stock may be further cold worked, for example, by stretching in the range of about 0.5% to 8% of its original length to relieve residual stresses therein and to improve the flatness of the product. Preferably the stretching is in the range of about 0.5% to 6%, more preferably of about 1% to 3%. After cooling the stock is artificially aged, preferably to provide a T7 condition, more preferably a T7×51 condition.

A desired structural shape or near-net structural shape is then machined from these heat-treated plate sections, more often generally after artificial ageing, for example.

SHT, quench, optional stress relief operations and artificial ageing are also followed in the manufacture of sections made by extrusion or forged processing steps.

The invention will now be illustrated with reference to non-limiting examples according to the invention.

Example 1

On an industrial scale of manufacturing rolling ingots of 6 different aluminium alloys have been DC-cast with dimensions of 1470×440 mm and several meters of length, except for alloy A3 having dimensions of 1260×440 mm. The aluminium compositions (in wt. %) are listed in Table 2 and whereby Alloy A1, A2 and A3 are comparative alloys and Alloy A4, A5 and A6 are according to the invention. Alloy A1 is within the composition ranges of AA7475, alloy A2 within AA7181 and alloy A3 within AA7010. The ingots have been stress-relieved as is regular in the art and followed by a two-step homogenisation heat treatment. Alloy A1 has been homogenized for 2 hours at 470° C. followed by 15 hours at 495° C., and alloys A2 to A6 have been homogenized each for 12 hours at 470° C. followed by 25 hours at 475° C. For logistical reasons following homogenisation the ingots have been cooled to ambient temperature using cooling rates regular in the art, scalped to improve ingot flatness and to remove the casting surface, and reheated to 410° C. and next hot rolled to a rolled product in multiple rolling steps to a thickness of 100 mm. Sub-samples have been taken from the hot rolled plate products and solution heat-treated for 24 hours at 470° C. in a laboratory scale furnace and cold water quenched. Following the samples have been artificially aged for 5 hours at 120° C. followed by 15 hours at 165° C. The artificial ageing practices applied brings the rolled products to a T76 temper. Next from the artificially aged material sub-samples were machined taken from the relevant location to dimensions for testing in accordance with the relevant norms.

TABLE 2

Alloy composition (in wt. %) of the six alloys tested. Balance is made by aluminium and unavoidable impurities.

| Alloy | Zn | Mg | Cu | Zr | Ti | Fe | Si | Cr |
|---|---|---|---|---|---|---|---|---|
| A1 | 5.87 | 2.40 | 1.62 | — | 0.03 | 0.06 | 0.04 | 0.20 |
| A2 | 7.38 | 1.96 | 1.64 | 0.12 | 0.03 | 0.04 | 0.02 | — |
| A3 | 6.37 | 2.33 | 1.76 | 0.12 | 0.03 | 0.05 | 0.03 | — |
| A4 | 6.49 | 2.52 | 1.76 | 0.11 | 0.03 | 0.03 | 0.016 | — |
| A5 | 6.57 | 2.30 | 1.76 | 0.11 | 0.03 | 0.03 | 0.016 | — |
| A6 | 6.99 | 2.48 | 1.57 | 0.11 | 0.03 | 0.03 | 0.017 | — |

Mechanical properties (tensile yield strength (TYS), ultimate tensile strength (UTS) and elongation $A_{50\ mm}$) in the L- and ST-direction were determined at quarter-thickness in accordance with the applicable norm EN 2002-1. The average over three samples are listed in Table 3.

The minimum life (in days) without failure due to stress corrosion cracking (SCC) measured in accordance with ASTM G47-98 at a short transverse (ST) stress level of 170 MPa have been tested. The results are also listed in Table 3 and all samples had a life time without failure of more than 30 days.

Also has been tested for the minimum $K_{max\text{-}dev}$ value without crack deviation due to crack propagation testing in standard atmosphere at room temperature in accordance with ASTM E647-13e01 in L-S direction on CT samples, testing in a load controlled fatigue test and crack deviation defined as a crack deviating more than 20° from the intended fracture plane. As used herein, "crack deviation resistance" is determined by preparing at least triplicate C(T) specimens in accordance with ASTM E647-13e01, entitled "Standard Test Method for Measurement of Fatigue Crack Growth Rates" ("ASTM E647"). The at least triplicate C(T) specimens are taken in the L-S direction from between width/3 and 2width/3 of the material, where the "B" dimension of the specimen is 6.35 mm (0.25 inch) and the "W" dimension of the specimen is at least 25 mm (0.98 inches), taken from T/2 position. The test specimens are tested per the constant load amplitude test method of ASTM E647, with R=0.1 (equal to $P_{min}/P_{max}$), ambient or high humidity air, at room temperature. The pre-crack must meet all validity requirements of ASTM E647, and the pre-cracking must be performed as required in ASTM E647. The test is started using a $K_{max}$>10 MPa√m. (9.098 ksi√inch), and the starting force must be large enough that crack deviation occurs before the ASTM E647 C(T) specimen validity requirement ($(W-a) \geq (4/\pi)*(K_{max\text{-}dev}/TYS)^2$) is no longer met for the test. The test must be valid per ASTM E647 up to the point of crack deviation. A crack "deviates" when the crack of the C(T) specimen substantially deviates from the intended fracture plane (e.g., by 20-110°) in any direction, and the deviation leads to specimen separation along an unintended fracture plane. The average crack length at deviation ($a_{dev}$) is derived by using the average of the two surface values (front and back values). $K_{max\text{-}dev}$ is the maximum stress-intensity factor calculated by using the average crack length at deviation ($a_{dev}$), maximum applied force ($P_{max}$), and the stress-intensity factor expression per ASTM E647 A1.5.1.1 for the C(T) specimen (Note: ΔK and ΔP should be replaced by $K_{max\text{-}dev}$ and $P_{max}$, respectively, per the stress ratio relationship $R=K_{min}/K_{max}$ and $\hat{K}=K_{max}-K_{min}$ as defined in ASTM E6473.2.14).

TABLE 3

Test results of all six alloys.

| Alloy | Tensile properties TYS (MPa) | UTS (MPa) | $A_{50\ mm}$ (%) | SCC (days) | Kmax-dev (MPa√m) |
|---|---|---|---|---|---|
| A1 | 444 | 517 | 14.47 | >30 | 47.40 |
| A2 | 469 | 523 | 15.40 | >30 | 38.25 |
| A3 | 493 | 540 | 13.37 | >30 | 45.42 |
| A4 | 522 | 573 | 11.60 | >30 | 50.09 |
| A5 | 503 | 551 | 12.67 | >30 | 49.67 |
| A6 | 524 | 572 | 12.03 | >30 | 52.19 |

From the results of Table 3 it can be seen that all aluminium alloys products have a good SCC resistance, which is a prerequisite for use in many aerospace applications.

From the results of Table 3 it can be seen that alloy A1 provides a very good SCC resistance in combination with a good resistance to crack deviation. However, at least the strength levels in the L-direction are very low rending the aluminium alloy not an ideal candidate for in particular structural aerospace applications.

Alloy A2 has a significantly increased Zn-content and providing higher strength levels in the L-direction. However, the resistance against crack deviation is significantly lower compared to alloy A1 and to alloy A3.

Compared to alloy A1, alloy A3 has due to at least a higher Zn-content also a higher strength in the L-direction. The resistance against crack deviation is slightly lower than alloy A1, which is according to expectation as one would expect that with increasing strength, in particular with increasing tensile yield strength, the $K_{max,dev}$ would decrease. Alloys A4, A5 and A6 according to this invention provide a favourable combination of good SCC resistance, increased strength levels and increased resistance against crack deviation. In FIG. 1, there is plotted the $K_{max,dev}$ against the TYS in L-direction for all alloys tested. From this FIGURE, it can be seen that alloy A6 provides the most favourable balance.

The invention is not limited to the embodiments described before, and which may be varied widely within the scope of the invention as defined by the appending claims.

The invention claimed is:

1. A wrought 7xxx-series aluminium alloy product having a composition comprising, in wt. %, Zn 6.50 to 7.20,
Mg 2.30 to 2.60,
Cu 1.30 to 1.80,
and wherein Cu+Mg<4.50, and wherein Mg<2.5+5/3 (Cu−1.2),
Fe up to 0.25,
Si up to 0.25,
and optionally one or more elements selected from the group consisting of:
Zr up to 0.3,
Cr up to 0.3,
Mn up to 0.45,
Ti up to 0.25,
Sc up to 0.5,
Ag up to 0.5,
the balance being aluminium and impurities, and wherein said product is aged to achieve:

a conventional tensile yield strength (in MPa) measured in the L-direction measured at quarter thickness of more than 485−0.12*(t−100) MPa (t being the thickness of the product in mm);
a minimum life without failure due to stress corrosion cracking (SCC) measured in accordance with ASTM G47-98 of at least 30 days at a short transverse (ST) stress level of 170 MPa; and
a minimum $K_{max\text{-}dev}$ value without crack deviation due to crack propagation testing in standard atmosphere at room temperature in accordance with ASTM E647-13e01 in L-S direction on CT samples of at least 40 MPa√m on average, testing in a load controlled fatigue test and crack deviation defined as a crack deviating more than 20° from the intended fracture plane.

2. The wrought 7xxx-series aluminium alloy product according to claim 1, wherein the Zn-content is at least 6.60%.

3. The wrought 7xxx-series aluminium alloy product according to claim 1, wherein the Zn-content is maximum 7.10%.

4. The wrought 7xxx-series aluminium alloy product according to claim 1, wherein Zn 6.75 to 7.10,
Mg 2.35 to 2.55,
Cu 1.35 to 1.75.

5. The wrought 7xxx-series aluminium alloy product according to claim 1, wherein Zn 6.75 to 7.10,
Mg 2.45 to 2.55,
Cu 1.35 to 1.75.

6. The wrought 7xxx-series aluminium alloy product according to claim 1, wherein said product has a Zr-content in a range of 0.03% to 0.25%.

7. The wrought 7xxx-series aluminium alloy product according to claim 1, wherein said product has a Cr-content in a range of 0.04% to 0.3%.

8. The wrought 7xxx-series aluminium alloy product according to claim 1, wherein said product has a Cr-content of up to 0.05%.

9. The wrought 7xxx-series aluminium alloy product according to claim 1, wherein said product has a Mn-content in a range of 0.05% to 0.4%.

10. The wrought 7xxx-series aluminium alloy product according to claim 1, wherein said product has a Mn content of up to 0.05%.

11. The wrought 7xxx-series aluminium alloy product according to claim 1, wherein said product has a sum of Mn+Cr up to 0.05%.

12. The wrought 7xxx-series aluminium alloy product according to claim 1, wherein said product has a thickness of at least 12.7 mm.

13. The wrought 7xxx-series aluminium alloy product according to claim 1, wherein said product is an aerospace product.

14. The wrought 7xxx-series aluminium alloy product according to claim 1, wherein said product is in a T7 condition.

15. The wrought 7xxx-series aluminium alloy product according to claim 14, wherein the product is in a T7 condition selected from the group consisting of T73, T74, T76, T77, and T79.

16. The wrought 7xxx-series aluminium alloy product according to claim 1, wherein the product has a thickness of at least 25.4 mm.

17. The wrought 7xxx-series aluminium alloy product according to claim 1, wherein said product is in the form of a rolled, extruded or forged product.

18. The wrought 7xxx-series aluminium alloy product according to claim 1, wherein the product is in the form of a rolled product.

19. The wrought 7xxx-series aluminium alloy product according to claim 1, wherein said product is aged to achieve one or more of:

a conventional tensile yield strength (in MPa) measured in the L-direction measured at quarter thickness of more than 500−0.12*(t−100) MPa (t being the thickness of the product in mm);
a minimum $K_{max\text{-}dev}$ value without crack deviation due to crack propagation testing in standard atmosphere at room temperature in accordance with ASTM E647-13e01 in L-S direction on CT samples of at least 50 MPa√m on average, testing in a load controlled fatigue test and crack deviation defined as a crack deviating more than 20° from the intended fracture plane;
a minimum life without failure due to stress corrosion cracking (SCC) measured in accordance with ASTM G47-98 of at least 30 days, at a short transverse (ST) stress level of 205 MPa.

20. The wrought 7xxx-series aluminium alloy product according to claim 1, wherein the wrought product is an aircraft structural part.

21. The wrought 7xxx-series aluminium alloy product according to claim 1, wherein the wrought product is an aircraft structural part selected from the group of a wing spar, wing rib, wing skin, floor beam, and fuselage frame.

* * * * *